US005145139A

United States Patent [19]

Holtsch

[11] Patent Number: 5,145,139

[45] Date of Patent: Sep. 8, 1992

[54] HOLDING DEVICE FOR CONTAINERS WITH TISSUES AND THE LIKE

[75] Inventor: Peter Holtsch, Taunusstein, Fed. Rep. of Germany

[73] Assignee: Holtsch Metallwarenherstellung, Wingsbach, Fed. Rep. of Germany

[21] Appl. No.: 710,368

[22] Filed: May 31, 1991

[51] Int. Cl.[5] ..... A47K 1/08

[52] U.S. Cl. ..... 248/313; 221/45; 248/905

[58] Field of Search ..... 248/313, 905, 316.1, 248/316.3, 316.4, 310; 211/50, 71; 221/45, 46, 282

[56] References Cited

U.S. PATENT DOCUMENTS

| | | | |
|---|---|---|---|
| 1,995,158 | 3/1935 | Thomasma | 221/46 X |
| 2,325,712 | 8/1943 | Shurmur | 248/313 |
| 3,285,559 | 11/1966 | Simon | 248/313 |
| 3,902,932 | 9/1975 | Gdanski et al. | 248/905 X |
| 4,176,817 | 12/1979 | Jones | 248/905 X |
| 4,995,530 | 2/1991 | Tabor | 248/905 X |

FOREIGN PATENT DOCUMENTS

| | | | |
|---|---|---|---|
| 8710763 | 1/1988 | Fed. Rep. of Germany . | |
| 1006541 | 6/1954 | France | 248/313 |

*Primary Examiner*—Ramon O. Ramirez
*Attorney, Agent, or Firm*—Michael J. Striker

[57] ABSTRACT

A holding device for holding containers with tissues and the like comprises a housing, an insert movable relative to the housing between a proximal position in which the container can be clamped between the insert and the housing and a distal position in which the insert is moved away from the housing so that the container can be removed from the device and a new container can be placed between the insert and the housing, and elements for elastically urging the insert toward the housing to the proximal position, so that the insert can be moved away of the housing toward the distal position by overcoming a resistance of the elastic elements. The elastic elements include at least one elastic band elastically connecting the insert with the housing.

7 Claims, 7 Drawing Sheets

FIG.10
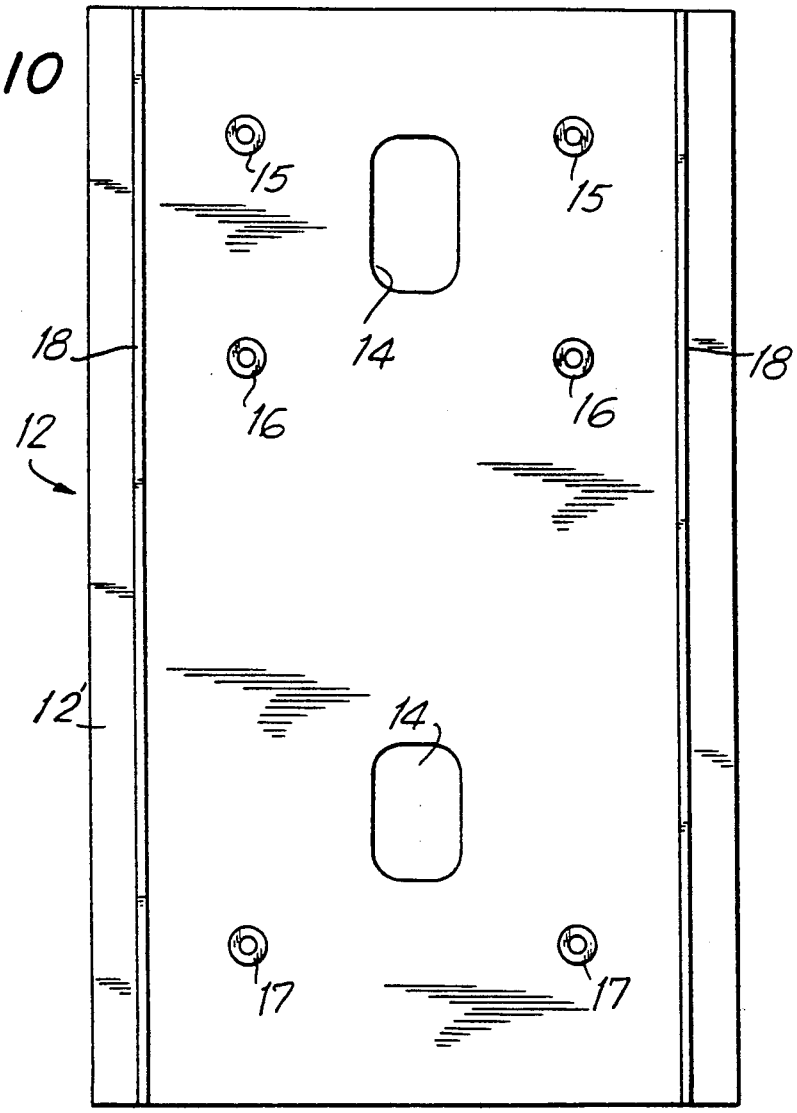
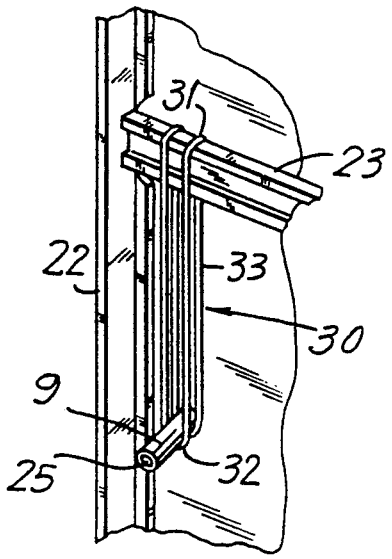
FIG. 11

HOLDING DEVICE FOR CONTAINERS WITH TISSUES AND THE LIKE

BACKGROUND OF THE INVENTION

The present invention relates generally to holding devices for holding containers which accommodate tissues and the like.

Holding devices of the above mentioned general type are known in the art. One of such holding devices is disclosed for example in the German document G 8710763.5. The holding device disclosed here has a housing, and an insert which is movable relative to the housing between a distal position in which the box with tissues can be inserted into the holding device, and a proximal position in which the insert has moved toward the housing so that the container with tissues is firmly held between the housing and the insert. The holding device is provided with projections which firmly engage the container with tissues. It is also provided with means for attaching to a supporting surface, for example holes for suspending on nails, or adhesive strips for adhesive attachment. The above mentioned holding device can be further improved.

SUMMARY OF THE INVENTION

Accordingly, it is an object of the present invention to provide a holding device which is a further improvement of the above mentioned known holding device.

In keeping with these objects and with others which will become apparent hereinafter, one feature of the present invention resides, briefly stated, in a holding device which has a housing, an insert movable relative to the housing between the distal position and proximal position, and elastic means elastically connecting the insert with the housing so that the insert can be moved to the distal position with overcoming the resistance of the elastic means, and the elastic means permanently pulls the insert toward the proximal position, wherein the elastic means is formed as at least one elastic band which is connected both to the insert and to the housing to elastically connect them with one another.

In accordance with a preferred embodiment of the invention, two rubber band elements connect the insert with the housing and are located at opposite sides of a longitudinal axis of symmetry of the device.

Still another feature of the present invention is that the insert is provided with two elongated members which are movable in two elongated slots of the housing and a transverse web connecting the elongated members with one another, while the elastic bands embrace the transverse web and their both ends are secured on a projection extending from the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 10 is a view from inside of the cover.

FIG. 11 is a perspective view showing an elastic element for elastically connecting the parts of the holding device with one another.

DESCRIPTION OF A PREFERRED EMBODIMENT

Figure 1:
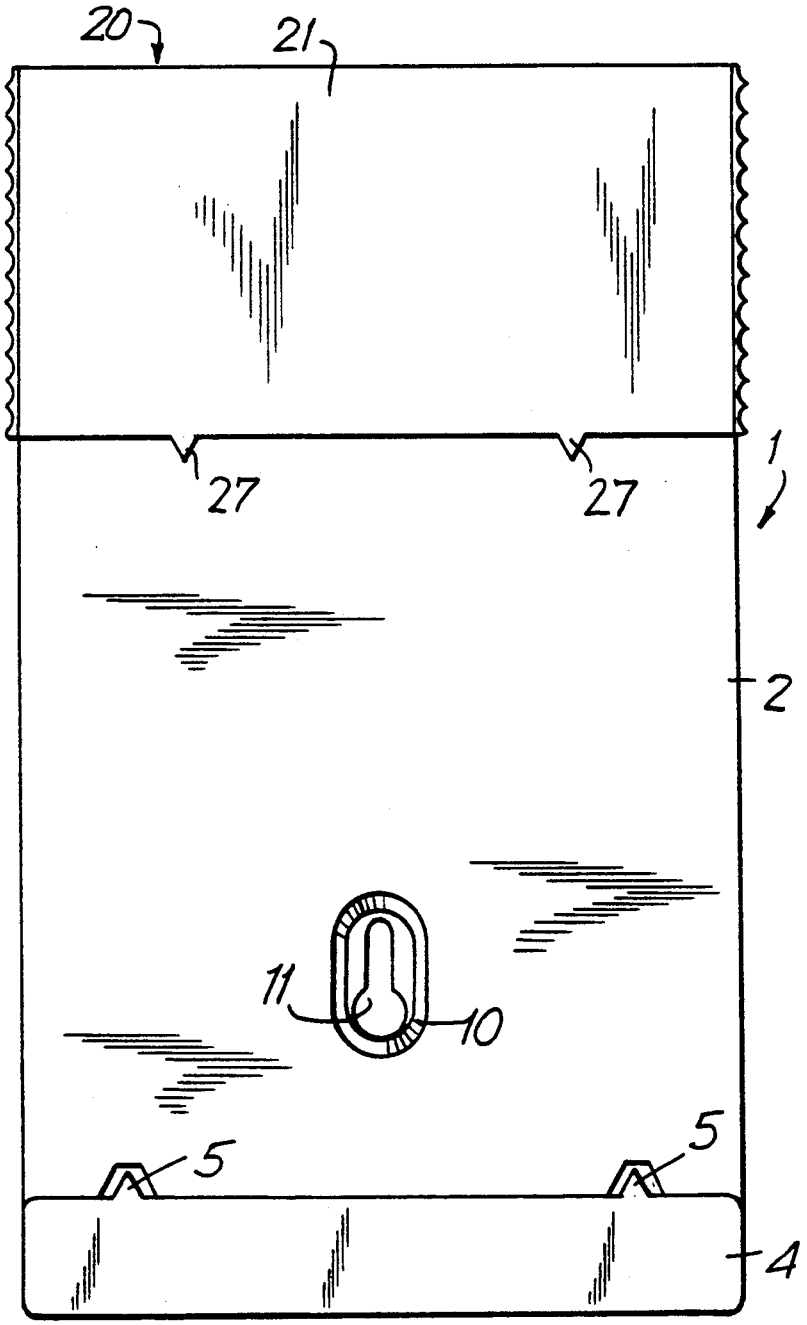
FIG. 1 is a front view of a holding device for holding containers for tissues in accordance with the present invention, in a proximal position of its part in which the container is clamped in the holding device.
Figure 2:
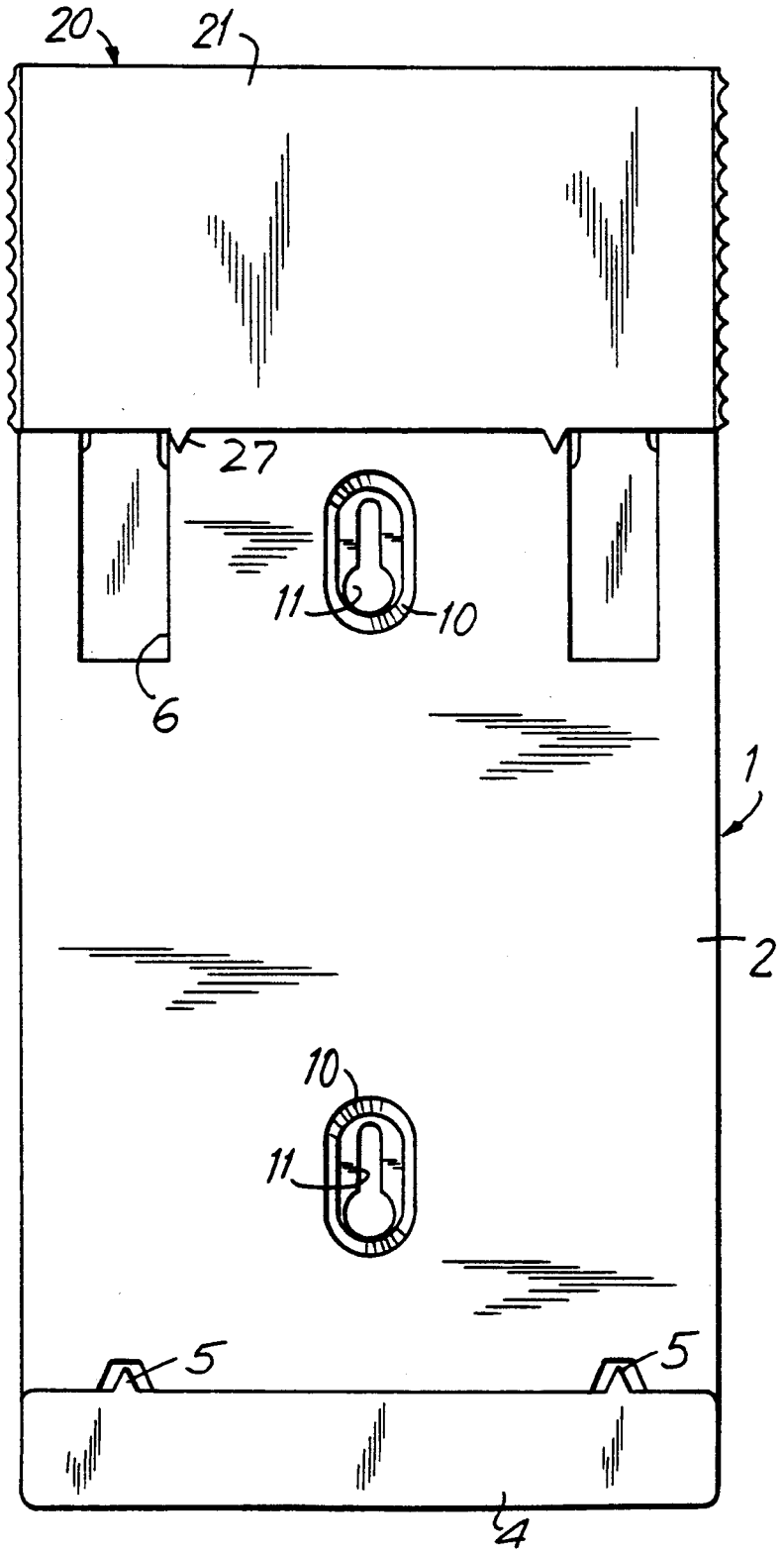
FIG. 2 is a view substantially corresponding to the view of FIG. 1 but showing the holding device with its parts in a distal position in which the parts are moved away from one another so that a new container can be inserted in the device.
Figure 3:
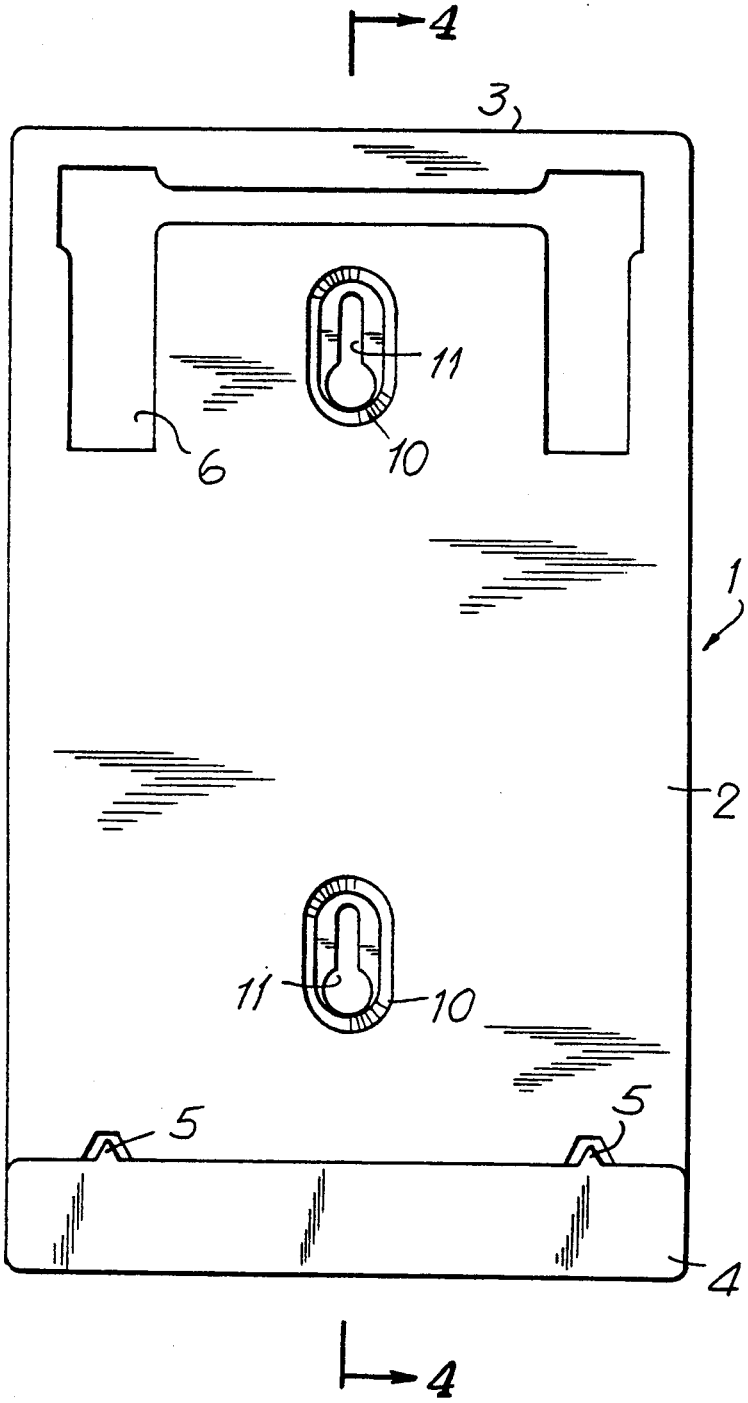
FIG. 3 is a front view with top portion removed.
Figure 4:
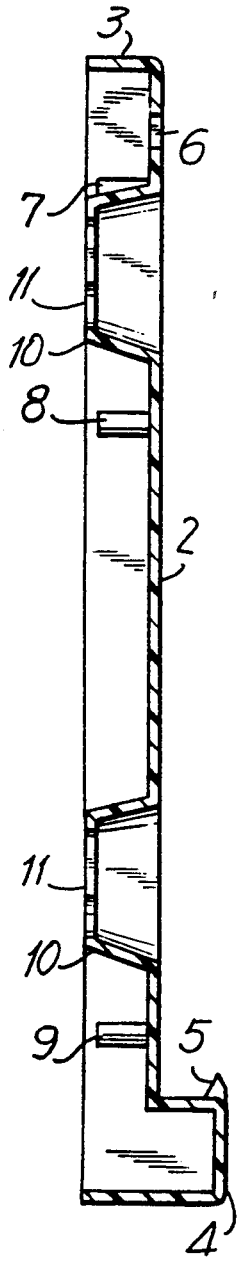
FIG. 4 is a section along line 4.4 of FIG. 3.
Figure 5:
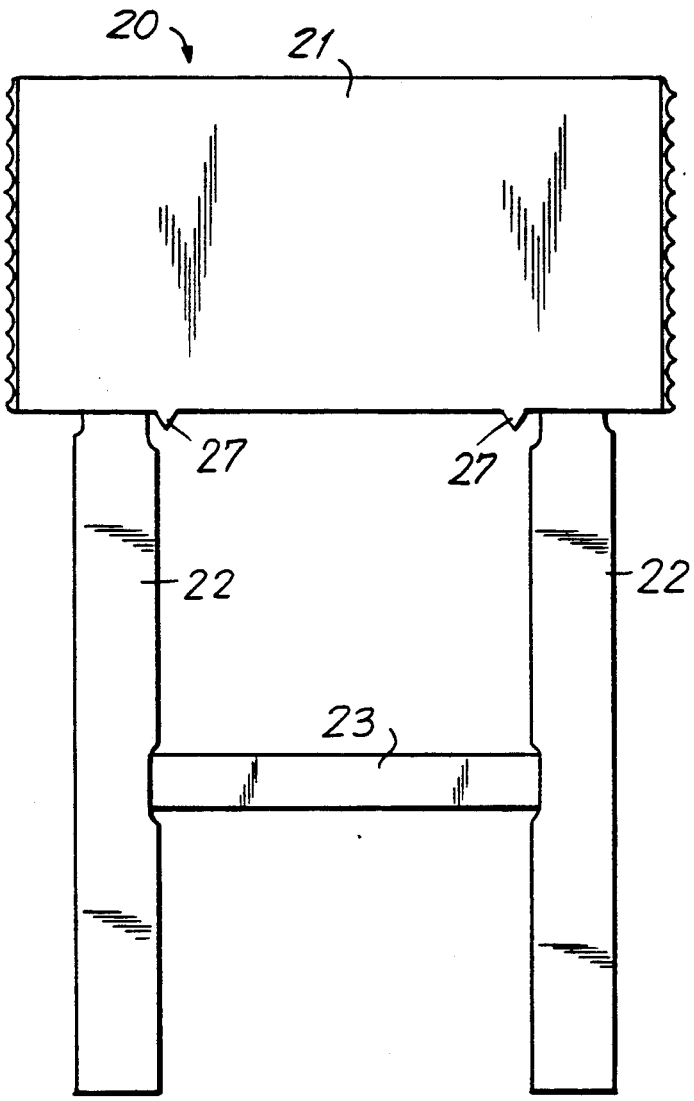
FIGS. 5 and 6 are a front view and a side view of an insert part of the holding device in accordance with the present invention.

A device for holding containers for tissues and the like has a housing composed generally of two parts. The first housing part is identified as a whole with reference numeral 1 and has a front wall 2 and an edge portion 3 extending along a contour of a front wall 2. On a lower end of the holding device the housing has a forwardly projecting flange 4 with two engaging tips 5. In the upper end of the holding device the housing has a slot 6 including two longitudinal slot portions connected by a transverse slot portion. The first housing part also has three pairs of pins 7, 8 and 9 arranged so that the pins of each pair are located at opposite sides of the longitudinal axis of symmetry of the first housing part and the holding device. The first housing part also has two projections 10 each provided with a throughgoing opening 11.

The housing further includes a second housing part identified as a whole with reference numeral 12. The second housing part is formed as a cover. It has a wall 12' provided with two openings 14. The cover is also provided with adhesive strips 14' for adhesively attaching the holding device to a surface. In an assembled condition of the housing the openings 14 of the cover 12 are aligned with the openings 11 of the housing part 1. The cover also has three pairs of pins 15, 16 and 17 arranged in correspondence with the pins 7, 8 and 9 of the housing part 1. Finally, the cover is provided on its inner side with two guiding projections 18. In the assembled condition of the device, the projections 18 serve for guiding an insert part of the device as will be explained hereinbelow.

Figure 6:
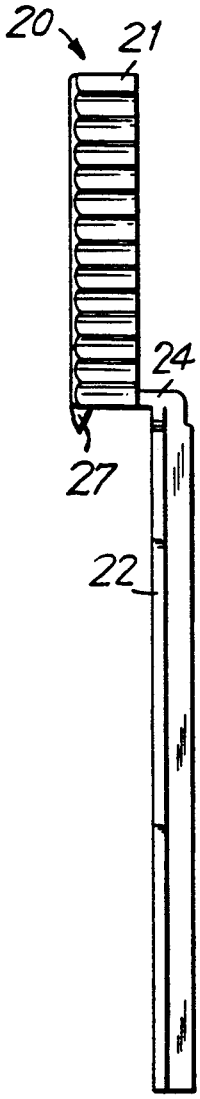

The holding device further has an insert part which is identified as a whole with reference numeral 20. The insert has an upper portion 21, two elongated members 22 extending from the upper portion 21, and a transverse connecting portion 23 which connects the elongated members 22 with one another at locations spaced from the portion 21. The elongated members 22 are laterally offset from the portion 21 as can be seen from FIG. 6. In assembled condition of the holding device, a connecting piece 24 between the portion 21 and the elongated member 22 extends through a longitudinal portion of the slot 6 of the housing part 1, and the longitudinal members 22 are in sliding contact with the rear surface of the housing part 1. The pins 7, 8, 9 are provided with threaded blind holes 25, while the pins 15, 16, 17 are provided with throughgoing openings 26. In the assembled condition of the housing, not shown screws extend from the rear side of the cover through the openings 26 into the threaded holes 25 so as to hold the housing parts 1 and 12 together. The upper portion 21 of the insert 20 is provided with tips 27 located substantially opposite to the tips 5 of the housing.

In accordance with the present invention, the insert 20 is connected with the housing and more particularly with the housing part 1 by elastic elements formed as rubber bands 30. The rubber bands 30 are located at opposite sides of the longitudinal axis of symmetry of the holding device.

Figure 7:
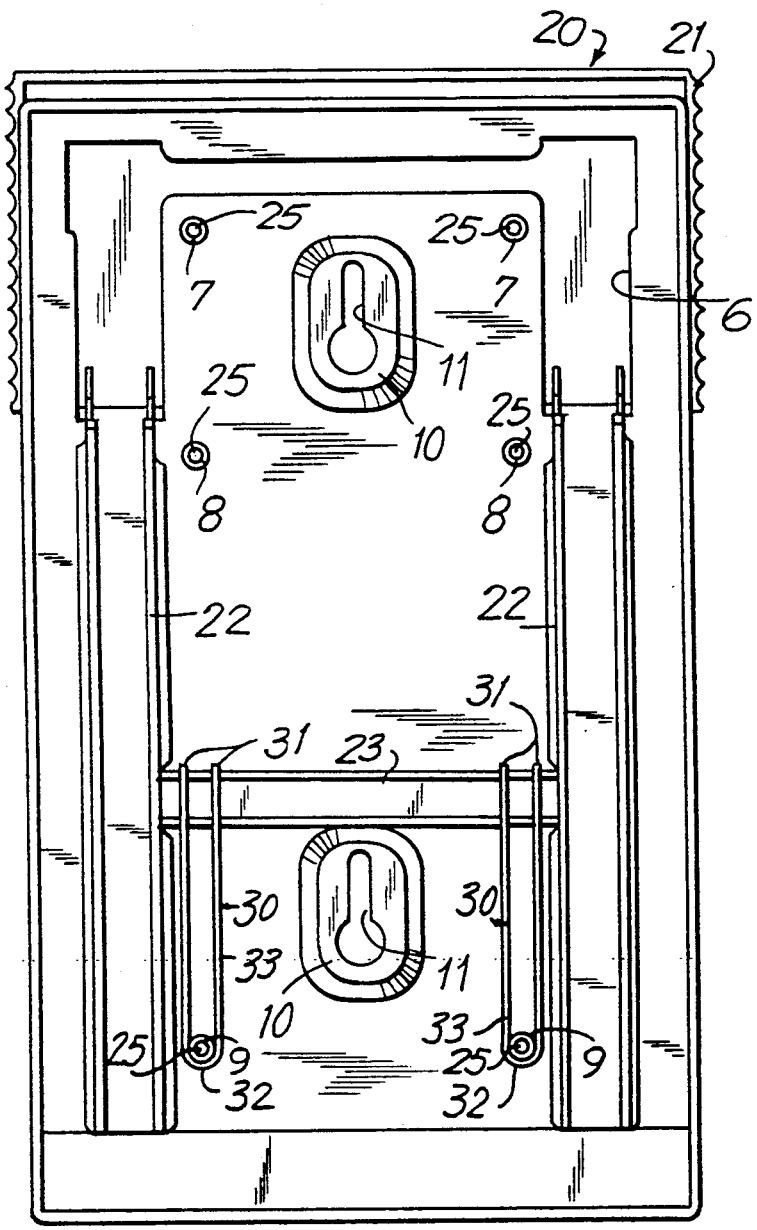
FIG. 7 is a rear view of the holding device in accordance with the present invention with a rear cover removed in the proximal position.
Figure 8:
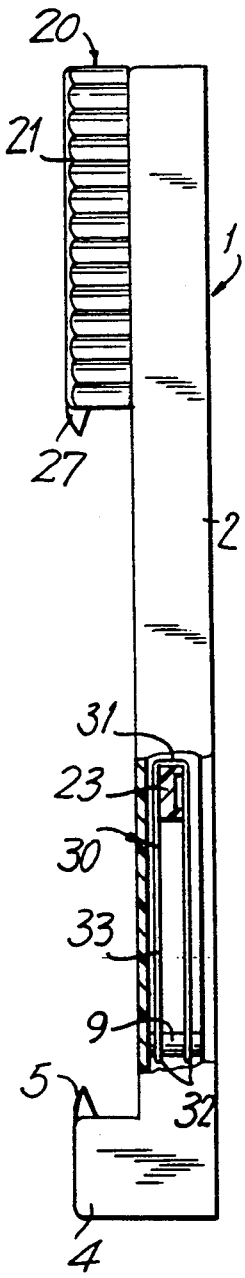
FIG. 8 is a side view showing a lower portion of the holding device in accordance with the present invention.
Figure 9:
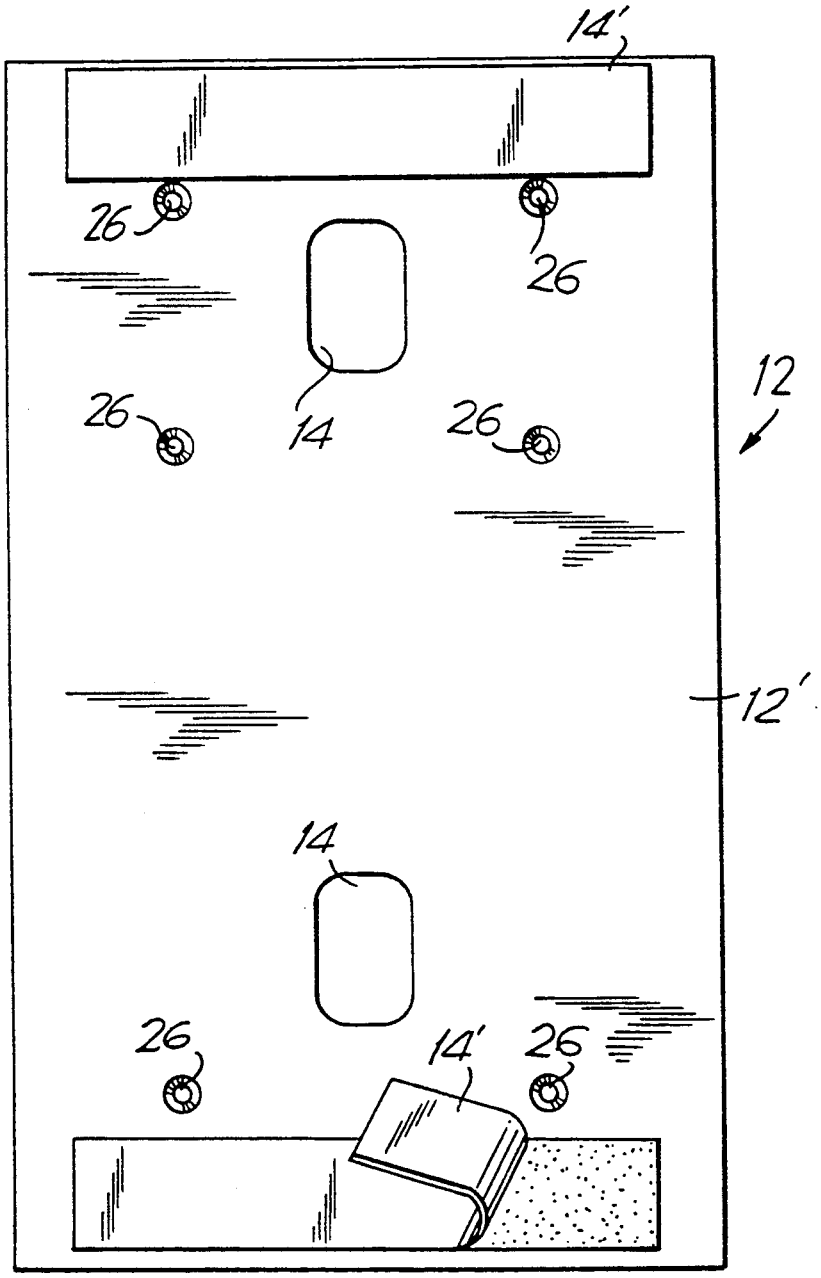
FIG. 9 is a view from outside of a cover of the inventive holding device.

Each elastic band 30 is formed as an endless band having two ends 31 and 32 which form loops and a main portion 33 extending between the ends 31 and 32. As can be seen from FIG. 7 and 11, each elastic band is bent over the connecting member 23 of the insert 20, while the ends 31 and 32 of the elastic band are fitted with their loops on the pin 9 at two locations spaced from one another in a direction of the axis of the pin. The elastic bands elastically pull the connecting member 23 of the insert 20 toward the pins 9, and therefore elastically pull the insert 20 to the housing part 1, to hold the housing part 1 and the insert 20 in their proximal position shown in FIG. 1. In this position the box inserted between the tips 27 and 5 is firmly held in the holding device. In order to exchange the box, the insert 20 is pulled upwardly by pulling its upper portion 21 upwardly away of the flange 4 of the housing part 1 so as to increase the distance between the tips 5 and 27. The thusly released box is removed from the holding device and a new box is inserted in the device. Then the user releases the insert and the bands 30 pull the insert downwardly so that the tips 27 move toward the tips 5 and clamp the new box in the holding device.

During movement of the insert part 20 relative to to the housing part 1 between the distal and proximal positions, the projections 18 of the cover 12 are located at opposite sides of the elongated members 22 of the insert 20. Therefore, the elongated members 22 and the insert 20 as a whole are guided during movement between these positions.

It will be understood that each of the elements described above, or two or more together, may also find a useful application in other types of constructions differing from the types described above.

While the invention has been illustrated and described as embodied in a holding device for holding containers with tissues, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A holding device for holding containers, comprising a housing having a pin; an insert movable relative to said housing between a proximal position in which the container can be clamped between said insert and said housing and a distal position in which said insert is moved away rom said housing so that the container can be removed from the device and a new container can be placed between said insert and said housing, said insert having a transverse web; and means for elastically urging said insert toward said housing to said proximal position, so that said insert can be moved away of said housing toward said distal position by overcoming a resistance of said elastic means, said elastic means including at least one elastic band elastically connecting said insert with said housing, said elastic band including two loop-shaped ends and an elastic portion extending between said ends, said elastic band being bent over said transverse web of said inert and fitted with its both ends on said pin at two locations which are spaced from one another in an axial direction of said pin.

2. A holding device as defined in claim 1, wherein said housing and said insert have a longitudinal axis of symmetry, said means including two such elastic elements located at opposite sides of said longitudinal axis of symmetry.

3. A holding device as defined in claim 1, wherein said housing has a housing part provided with said pin and a cover connectable with said housing part by a threaded member, said cover having a throughgoing opening, said pin having a threaded blind hole formed so that the threaded member can extend through the throughgoing opening of said cover into said threaded blind hole of said pin to connect said cover with said housing part of said housing, said pin simultaneously performs the function of connecting said cover with said housing part and fitting said ends of said elastic band.

4. A holding device as defined in claim 1, wherein said housing has means for attaching to a supporting surface, said means including two attaching elements, one of said attaching elements being formed as a hole for suspending said housing on a nail or the like, while the other of said attaching elements is formed as an adhesive strip for adhesively attaching said housing.

5. A holding device for holding containers, comprising a housing having a housing part provided with a pin with a hole and a cover connectable with said housing part by a member engaging into said hole of said pin to thereby connect said cover with said housing part; an insert having a transverse web and movable relative to said housing between a proximal position in which the container can be clamped between said insert and said housing and a distal position in which said insert is moved away from said housing so that the container can be removed from the device and a new container can be placed between said insert and said housing; and means for elastically urging said insert toward said housing to said proximal position, so that said insert can be moved away of said housing toward said distal position by overcoming a resistance of said elastic means, said elastic means including at least one elastic band elastically connecting said insert with said housing, said elastic band being bent over said transverse web of said insert and having ends fitted on said pin, so that said pin simultaneously performs the function of connecting said cover with said housing part by engaging said member into said hole of said pin and also the function of fitting said ends of said elastic bands.

6. A holding device for holding containers, comprising a housing; an insert movable relative to said housing between a proximal position in which the container can be clamped between said insert and said housing and a distal position in which said insert is moved away from said housing so that the container can be removed from the device and a new container can be placed between said insert and said housing; and means for elastically urging said insert toward said housing to said proximal position, so that said insert can be moved away of said housing toward said distal position by overcoming a resistance of said elastic means, said elastic means including at least one elastic band elastically connecting said insert with said housing, said insert having two longitudinal members and a transverse web which connects said longitudinal members with one another, said housing having two elongated slots through which said longitudinal members can pass so as to slide on said housing.

7. A holding device for holding containers, comprising a housing; an insert movable relative to said housing between a proximal position in which the container can be clamped between said insert and said housing and a distal position in which said insert is moved away from said housing so that the container can be removed from the device and a new container can be placed between said insert and said housing; and means for elastically urging said insert toward said housing to said proximal position, so that said insert can be moved away of said housing toward said distal position by overcoming a resistance of said elastic means, said elastic means including at least one elastic band elastically connecting said insert with said housing, said insert having two longitudinal members and a transverse web connecting said longitudinal members with one another, said housing having two elongated slots through which aid longitudinal members pass so as to slide on said housing, said housing also having a housing part and a cover connected with said housing part and provided with two projections extending outwardly of said longitudinal members of said insert so as to guide said longitudinal members and therefore said insert during movement of said insert between said distal and proximal positions.

* * * * *